United States Patent [19]

Zipper

[11] Patent Number: 4,860,910

[45] Date of Patent: Aug. 29, 1989

[54] PAPER SEPARATION DEVICE FOR WASTE CONTAINERS

[75] Inventor: Joseph D. Zipper, Farmingdale, N.Y.

[73] Assignee: State University of New York, Albany, N.Y.

[21] Appl. No.: 199,603

[22] Filed: May 27, 1988

[51] Int. Cl.[4] ..... B65D 90/00

[52] U.S. Cl. ..... 220/1 T; 220/23; 232/43.1

[58] Field of Search ..... 220/1 T, 20, 23; 232/24, 43.1

[56] References Cited

U.S. PATENT DOCUMENTS

| | | | |
|---|---|---|---|
| 642,409 | 1/1900 | Yancy | 220/1 T |
| 997,478 | 7/1911 | Toomy | 232/24 |
| 1,013,775 | 1/1912 | Hoffman | 220/20 |
| 1,021,872 | 4/1912 | Kingsbury | 220/1 T |

*Primary Examiner*—George L. Walton

*Attorney, Agent, or Firm*—Hoffmann & Baron

[57] ABSTRACT

The present invention is a paper separation device for placement over the central opening of a standard or like waste container. The paper separation device comprises a housing having continuous walls forming an enclosure, and a means for maintaining a housing upon the waste container. A lower opening is formed in one of the walls, for entry of waste and like articles into the waste container. A partition is disposed in the enclosure having at least a portion of the partition adjacent the lower opening and located thereabove for receipt and storage of sheets of paper within the enclosure. An upper opening is formed above the lower opening in the wall, for inserting therethrough sheets of paper within the enclosure. Also, a top opening is formed in the housing above the partition so that stored sheets of paper in the enclosure can be removed therefrom for recycling purposes.

7 Claims, 3 Drawing Sheets

PAPER SEPARATION DEVICE FOR WASTE CONTAINERS

FIELD OF INVENTION

The present invention relates generally to paper separation devices for placement over the central opening of waste containers, and more particularly to such paper separation devices which are to be primarily used for separating office waste paper from other office trash, and for storing the same so that the paper can be used for recycling purposes.

BACKGROUND OF THE INVENTION

Paper in a variety of forms (office paper, corrugated paper, newspaper, etc.) accounts for approximately 30% of municipal solid waste. Along with aluminum cans, paper is a component of the municipal solid waste stream that is perhaps most amenable to recycling.

Approximately 20% of total U.S. paper consumption is recycled. Most of the paper recycled in the U.S. is newsprint or corrugated paper. Wastepaper forms a very sizeable fraction of the total waste stream emanating from modern offices and represents a valuable commodity that could produce additional economic return to society if recycled.

Of the various types of wastepaper, one in particular is mixed (white and colored) office paper, including bound and unbound sheets of standard or legal-sized paper (ledger paper), and computer paper. Such material generally comprises at least 50% of office-generated solid waste. An individual working in a modern automated office discards about 2–3 lbs. of mixed office paper each week. Conservative estimates suggest that this material constitutes up to 30% of the total municipal waste stream entering landfills in, for example, New York State.

In view of the waste paper problem, there are several competing solutions. In particular, high-grade office paper can be de-inked, shredded, hydropulped, and processed into new paper or paperboard products at a paper mill.

Recycling paper also has a number of environmental and economic benefits. The manufacture of paper products from virgin wood is an energy-intensive process, requiring approximately 6,730 KWH for each ton of paper produced. Substantially less energy (2,520 KWH/ton) is required to produce a ton of new paper from recycled unprinted paper.

Recycling paper also places less demand on finite timber resources. Although U.S. wood production continues to outpace domestic consumption, the gap is shortening. As timber prices rise, periodic shortages of virgin wood will develop, increasing the demand for waste paper.

In view of the above-identified waste paper problem, and the benefits derived from recycling waste paper, it is apparent that there is great need to provide an effective way to separate waste paper from other waste materials and to collect the waste paper in a manner which is efficient from a paper recycling perspective.

A variety of prior art garbage and waste paper receptacles are known to be useful in a variety of settings, but each is plagued with particular shortcomings or drawbacks as to make it undesirable for paper recycling purposes. Examples characteristic of such prior art paper receptacles can be found in U.S. Pat. Nos. 1,021,872 and 642,409.

U.S Pat. No. 1,021,872 to Kingsbury discloses a refuse and waste paper receptacle having a lower refuse can which can be swung out for the purpose of receiving garbage. This refuse is contained in the lower part of a frame or casing which is provided with a flue to carry off odors. In the upper part of the frame, a removable basket is provided for deposit of waste paper. The receptacle of the Kingsbury disclosure has several significant shortcomings. In particular, it requires a specifically designed receptacle frame for supporting a removable basket, and cannot be used with a standard waste basket found, for example, in an office environment. The Kingsbury receptacle also requires that the lid be lifted for each insertion of waste paper into the removable basket, and it also does not ensure that paper will be collected in a flat, stacked, and uncrumpled manner.

U.S. Pat. No. 642,409 to Yancey discloses a refuse box which includes a hinged cove for receipt of garbage, and a rectangular shaped compartment on the back of the box to be used as a receptacle for waste paper and the like. The refuse box of the Yancey disclosure is also plagued with several significant drawbacks as well. In particular, the refuse box is not useful as a waste receptacle in an office setting, and respective lids must be lifted each time waste paper or recyclable paper is to be inserted into its respective storage compartment. Moreover, the refuse box of Yancey cannot be used in conjunction with standard office wastebaskets for separation of paper from refuse to be entered into the wastebasket. Also, removal of collected paper is most difficult using the refuse box of Yancey, and it does not ensure that paper will be collected in a stacked, flat and uncrumpled manner..

In view of the above prior art paper collection and refuse containers, it is apparent that the prior art has not shown or even hinted how to achieve paper separation with a device that attaches to the central opening of a standard office waste container, and having a combination of features which include (i) automatic flat orderly stacking of paper to be recycled; (ii) separation of recyclable paper from rubbish collected in the standard office waste container, (iii) easy removal of collected stacked recyclable paper and (iv) lightweight rugged construction which is virtually maintenance free.

Accordingly, it is a primary object of the present invention to provide a paper separation device for placement over or attachment to the central opening of a standard waste container. The paper separation device of the present invention is primarily intended for use in segregating office waste paper from other office trash, and for achieving the same so that the collected paper can be used for recycling purposes.

It is a further object of the present invention to provide such a paper separation device wherein recyclable paper can be simply separated from other office rubbish, and automatically stacked in a flat or uncrumpled and orderly fashion without the need of any assistance from its user.

An even further object of the present invention is to provide such a paper separation device of unitary construction made from a high impact plastic using injection molding, rotational molding, and vacuum forming technologies.

Other and further objects of the present invention will be explained hereinafter, and will be more particularly delineated in the appended claims, and other objects of the present invention will hereinafter become apparent to one with ordinary skill in the art to which the present invention pertains.

SUMMARY OF THE INVENTION

The present invention is a paper separation device for placement over the central opening of a standard or like waste container. The paper separation device comprises a housing having continuous walls forming an enclosure, and a means for maintaining the housing upon the waste container. A lower opening is formed in one of the walls, for entry of waste and like articles of rubbish into the waste container. A partition is disposed in the enclosure having at least a portion of the partition adjacent the lower opening and located thereabove for receipt and storage of sheets of paper within the enclosure. An upper opening is formed above the lower opening in the wall, for inserting sheets of paper into the enclosure. Also, a top opening is formed in the housing above the partition so that stored sheets of paper in the enclosure can be removed for recycling purposes.

In the preferred embodiment of the present invention, the paper separation device further includes a top cover panel hingedly connected to the housing for covering the top opening. Also, a lower panel preferably is provided which is hingedly connected to the housing for covering the lower opening. The lower panel depends downwardly from the housing to cover the lower opening and is capable of swinging inwardly for entry of waste and like articles into the waste container. Preferably, the housing and the means for maintaining the housing upon the waste container are integrally formed. In the preferred embodiment, this is achieved by forming the paper separation device from a high impact, high-density modern plastic using injection molding technology or rotational-molding processes, known in the art.

The housing of the paper separation device of the present invention may take on one of many forms, however, it has been found advantageous that the preferred embodiment have a housing including a planar wall through which the upper and lower openings are formed. This allows the user to simply select the opening through which paper or other waste is to be inserted. In the preferred embodiment, the housing includes a front, a back and a pair of side walls, which together form a polygonal configuration. Through the front wall, the upper and lower openings are formed. The top or upper portion of the polygonal configuration is open and the partition comprising a bottom wall is disposed below the perimeter of the opening at a distance sufficient to form a storage space or compartment within the enclosure. Notably, one feature of the present invention is to provide for the receipt of flat uncrumpled storage of sheets of paper within the storage space. Entry of recyclable paper into the storage space is provided through the upper opening formed in the front wall of the housing, whereas removal of the collected paper is through the top rear opening of the housing.

The top cover panel is hingedly connected to the rear upper opening of the housing to close off the opening of the storage compartment, formed by the front, rear and side walls. The housing is joined at its lower end to a base having a means for receiving the upper portion of a waste container for simple and stable attachment thereto.

In the preferred embodiment, the partition can be provided in the form of a hinged support panel which extends to the bottom of the storage compartment for easy removal of flatly stacked recyclable paper collected in the storage compartment. The hinged partition preferably rests on a short panel member extending from the lower portion of the rear wall towards the upper opening, and is hingedly attached to the rear of the front wall proximate the top portion thereof so that it can be tilted upwardly in a direction similar to that of the top cover panel of the housing. The partition can also be provided with a flexible pull tab which while projecting slightly over the rear wall when the top cover panel is closed, is designed to be pulled upward by a user to lift the hinged partition and thus the stacked recycled paper upwardly and out from the storage compartment, for simple removal therefrom. This feature of the present invention minimizes the difficulty of removing paper from the storage compartment of the paper separation device, at the end of a work day.

As a result of the present invention, simple and effective separation and storage of recyclable office paper can be achieved at the same site where other waste materials in an office setting would otherwise be disposed of. Accordingly, the paper separation device allows office workers to easily, conveniently, and effectively segregate target waste paper from typewriter ribbons, worn paper clips, photocopier cartridges, spent pens, etc. by putting the paper separation device of the present invention as close to the point of waste origin as possible, thereby improving worker cooperation and maximizing paper recovery.

In addition, the paper separation device of the present invention achieves stacking of the recycled paper in a flat or uncrumpled fashion thereby having several notable advantages over other waste paper collection systems. In particular, the paper separation device of the present invention achieves automatic stacking of recyclable paper in flat or uncrumpled fashion which:

1. Decreases the volume of stored paper;
2. Increases exposed surface area of paper which results in decreased amount of time used for (i) deinking of paper and for (ii) turning paper into mash;
3. Provides clean paper which is necessary for marketing to a vendor;
4. Provides easier handling and collecting;
5. Provides easier sorting of paper by type after collection; and
6. Facilitates the identification of documents inserted into the paper separation device by accident.

A primary advantage of the present invention is that simple automatic separation of recycled paper is provided at the point of entry of trash within an office waste container, and yet facilitates the disposal of other waste into the waste container at the same time.

Another advantage is that the present invention does not require an additional or separate waste container as required by prior art devices, but need only be placed or otherwise attached to the central opening of pre-existing standard waste containers typically found in office and other institutional settings.

DESCRIPTION OF DRAWINGS

For a further understanding of the objects of the present invention, reference is made to the following detailed description of the preferred embodiment which is to be taken into connection with the accompanying drawings, wherein.

DETAILED DESCRIPTION OF THE PREFERRED EMBODIMENT

Figure 1:
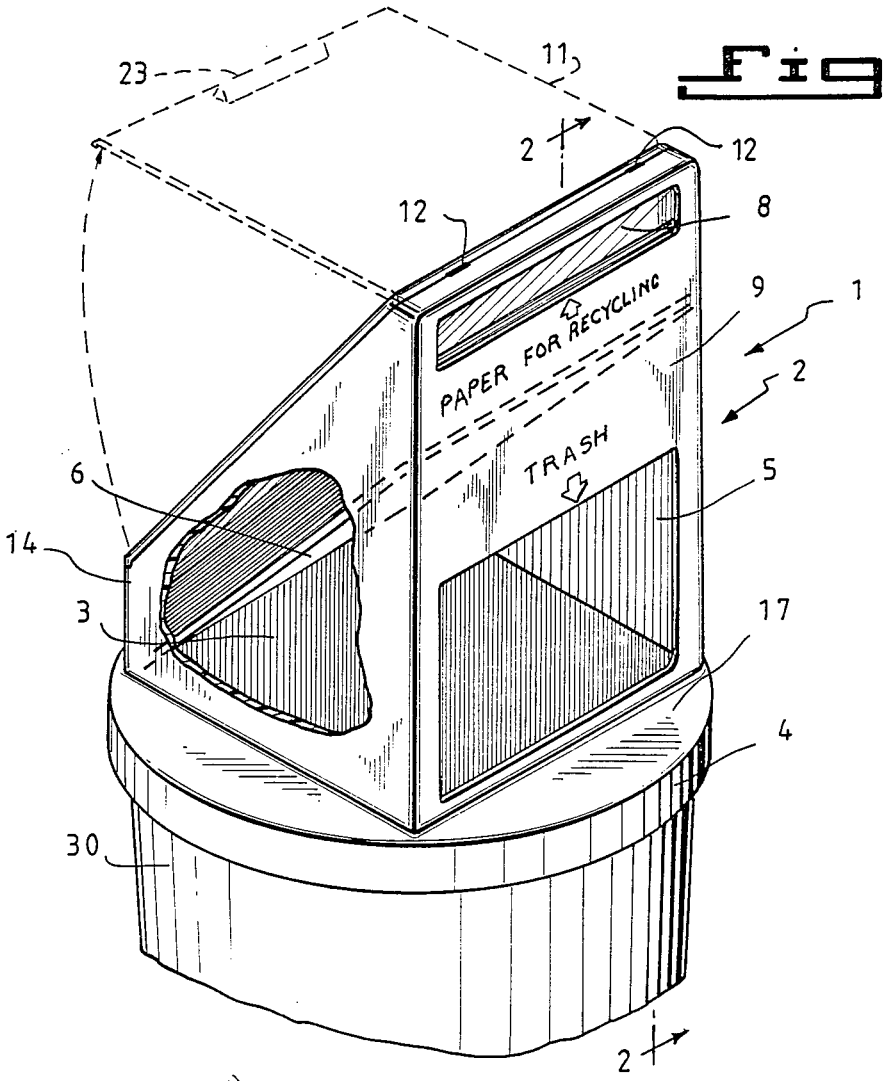
FIG. 1 is perspective view of the paper separation device of the present invention placed upon the central opening of a conventional waste container.

Referring to FIGS. 1, 2, 3 and 4, the paper separation device 1 of the present invention is shown placed upon and over the central opening of a standard waste container 30 found, for example, in an office environment near a desk or door exit.

The paper separation device 1 generally includes a housing 2 having continuous walls forming an enclosure 3 and a depending flange 4 for maintaining the device on the waste container 30. A lower opening 5 is formed in one of the walls, for entry of like articles into the waste container 30. A partition 6 is disposed in the enclosure 2 having one edge 7 fixed above the opening 5 for receipt and storage of sheets of paper on the partition 6, but within the enclosure. An upper opening 8 is formed above the lower opening 5 in the wall 9 for inserting sheets of paper onto the partition 6 within the enclosure. Also, a top opening 10 is formed in the housing 2 above the partition 6 so that the stored sheets of paper in the enclosure 3 can be removed for recycling purposes.

In the preferred embodiment of the invention, the paper separation device 1 further includes a top cover panel 11 hingedly connected to the housing 2 for covering the top opening 10 Such a connection can be provided by use of hinges 12 connected to the housing 2 and top cover panel 11.

Figure 5:
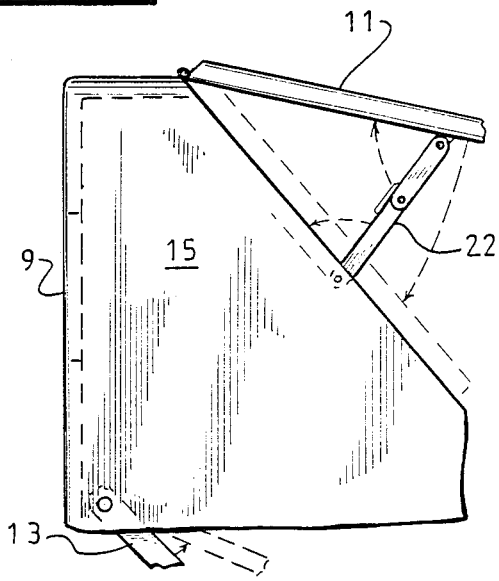
FIG. 5 is an elevated side view of the upper portion of the paper separation device of the present invention, partially broken away, showing the top cover panel hingedly connected to the housing disposed in open position, and also showing the swinging cover panel of the lower opening of the housing extended from its normal depending position.

Optionally, a lower panel 13, shown in FIG. 5, can be hingedly connected to the housing 2 for covering the lower opening 5 in the device. Panel 13 depends downwardly from the housing 2 to cover the lower opening 5 and is capable of swinging inwardly for entry of waste and like articles into the waste container 30.

Preferably, the housing 2 and the depending flange 4 for maintaining the housing 2 upon the waste container 30, are integrally formed. In the preferred embodiment this is achieved by forming the paper separation device from a high-impact, high-density modern plastic such as high density polyethylene using a rotational molding process known in the art.

While the housing 2 of the paper separation device hereof may take on one of many forms, the preferred embodiment has a housing 2 including a planar wall 9 through which the upper and lower openings 5 and 8 respectively, are formed. In the preferred embodiment, the housing 2 comprises a front, a back and a pair of side walls, 9, 14, and 15 and respectively, which together form a polygonal configuration. The top or upper portion of the housing of the preferred embodiment, forms a top opening 10 and the partition 6 is disposed below the perimeter of the top opening 10 at a distance sufficient to form a storage space or compartment 16 within the housing enclosure 3.

The top cover panel 11 is hingedly connected by one edge to the top opening 10 of the housing 2 to selectively close off the top opening 10. The front, rear and side walls, 9, 14, and 15, respectively, are joined at their lower ends to a base 17 having at the perimeter thereof the depending flange 4 for receiving the upper portion of a waste container 30, for simple and stable attachment thereto. A projection 23 is provided to the bottom portion of the top cover panel 11 to facilitate lifting the same in an upward manner as illustrated in FIGS. 1–4.

Figure 4:
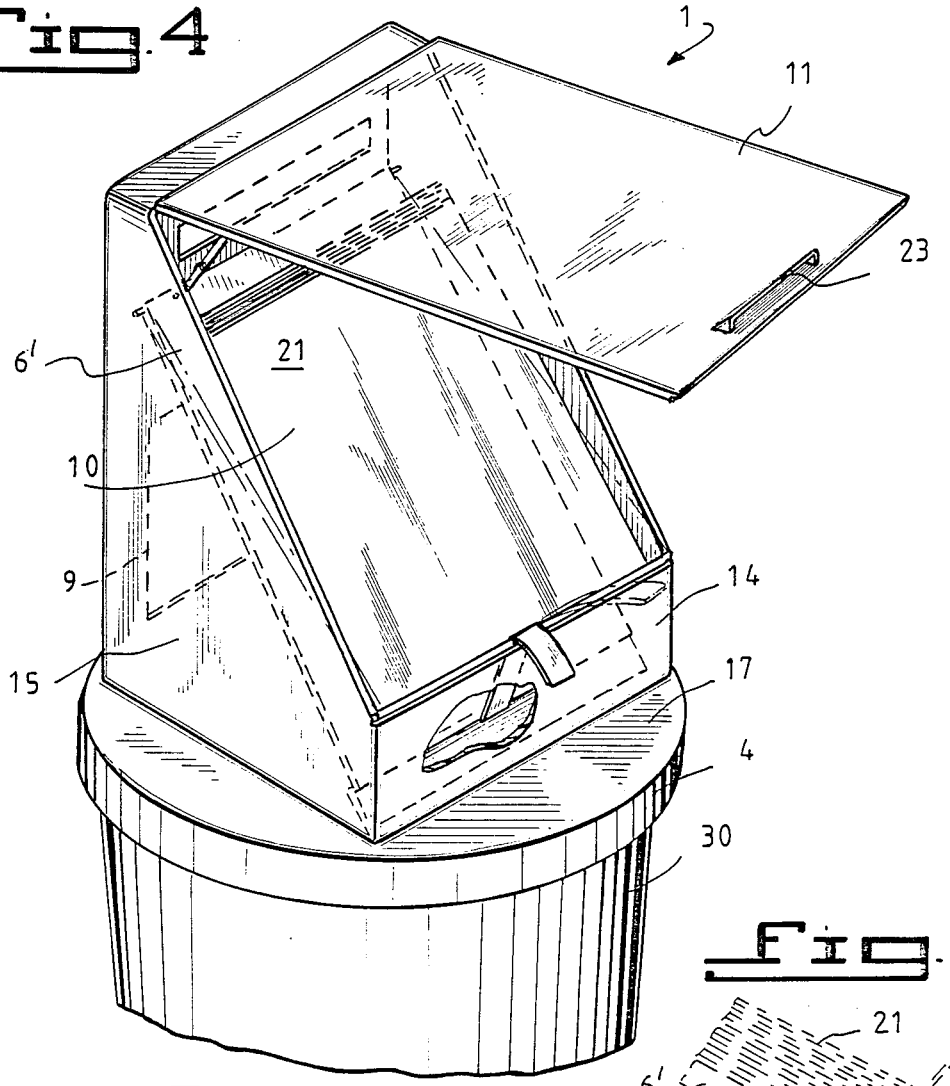
FIG. 4 is a perspective view of the rear portion of the paper separation device of the present invention placed upon the central opening of a waste container, showing numerous sheets of stacked recyclable paper collected within the enclosure of the housing, with the top rear panel disposed in open position for removal of the sheets of stacked paper.
Figure 6:
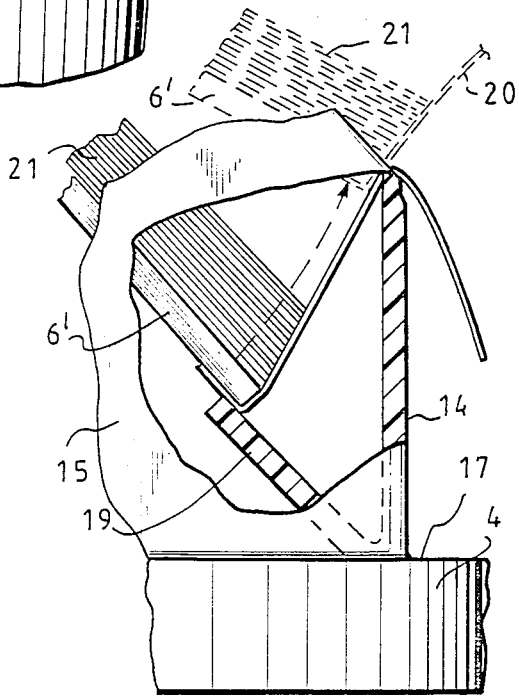
FIG. 6 is an elevated side view of the rear portion of the paper separation device of the present invention, shown partially broken away, illustrating the removal of stacked recyclable paper in the housing using the tiltable partition and pull tab feature of the present invention for simple removal of stacked sheets of paper therefrom.

Referring to FIGS. 4, 5, and 6, another feature of the present invention is illustrated which provides for easy removal of flatly stacked recyclable paper collected in the storage compartment 16. Specifically in the preferred embodiment, the partition 6′ is hinged at its upper portion to the side or front wall 15 and 9 respectively, by way of hinge 18. As illustrated in FIGS. 4 and 6, the bottom portion of the hinged partition 6′ normally rests upon the edge of a short panel member 19 which projects, i.e. extends, from the rear wall 14 and/or base within the housing enclosure, towards the upper opening 8. The normal position of the hinged partition 6′ is shown in phantom view in FIG. 4. The hinged partition 6′ is tiltable upward in a direction similar to that of the top cover panel 11 of the housing, which is shown in open position in FIG. 4.

The tiltable partition 6′ is provided with a flexible tab 20 which, while projecting slightly over the rear wall 14 when the top cover panel 11 is closed, is designed to be pulled upward by a user to lift the hinged partition 6′ and thus the stacked recyclable paper 21 upward and out from the storage compartment 16 for simple removal therefrom. The flexible tab 20 can be made from a flexible plastic material, leather, or other functionally equivalent material. The connection of the tab 20 to the bottom portion of the hinged or tiltable partition 6′, can be achieved using adhesive material or other fastening device suitable for the purpose.

Referring to FIG. 6, the bottom portion of the hinged partition and tab arrangement is illustrated in detail. In particular, the short panel member 19 is shown integrally formed with the rear wall 14 and serves as a support for the bottom portion of the hinged tiltable partition 6′ as described hereinabove.

Referring to FIG. 5, the top cover panel 11 hinged to the upper portion of the housing enclosure 2 is shown held in a locked open position by way of foldable hinged support 22 known in the art. These support members 22 serve to hold the top cover panel 11 in open position when removing the collected recyclable paper 21 from the storage compartment 16 of the paper separation device 1. This feature of the present invention, in cooperation with the pull tab 20 illustrated in FIG. 6, provides for simple removal of stacked recyclable paper 21 from the storage compartment 16 without risk of disorganizing the stacked paper and without the assistance of another office worker. In FIG. 5, the hinged swingable panel 13 covering the lower opening 5 is also illustrated, partially broken away shown in its open position.

The operation of the paper separation device 1 of the present invention is quite simple. An office worker, or like person who desires to recycle sheets of paper, inserts the sheets through the upper opening 8 which automatically collects the paper in a stacked uncrumpled orderly fashion within the storage compartment 16, whereas, other trash or rubbish such as typewriter ribbons, apple cores, juice containers, and other refuse produced during a work day is inserted through the lower opening 5 of the paper separation device 1. When the storage compartment 16 is filled to its capacity with recyclable paper, then an office worker or person assigned with the task of collecting recyclable paper, can simply remove the collected paper into an appropriate storage bin.

The operation by which the removal of paper from the device 1 is achieved as follows. The top cover panel 11 is lifted upwardly to its open position until the support members 22 lock, thereby providing support and maintaining the top cover panel 11 in an open position. The flexible pull tab 20 is then lifted upwardly towards the top cover panel 11 in order to tilt the hinged partition 6′ so that the stack of recyclable paper 21 is disposed in a position slightly above the upper portion of the rear wall 14. When the stacked recyclable paper 21 is in such a position as illustrated in FIG. 6, then it can be simply removed from the storage compartment 16 without crumpling or disorganizing the same.

Figure 2:
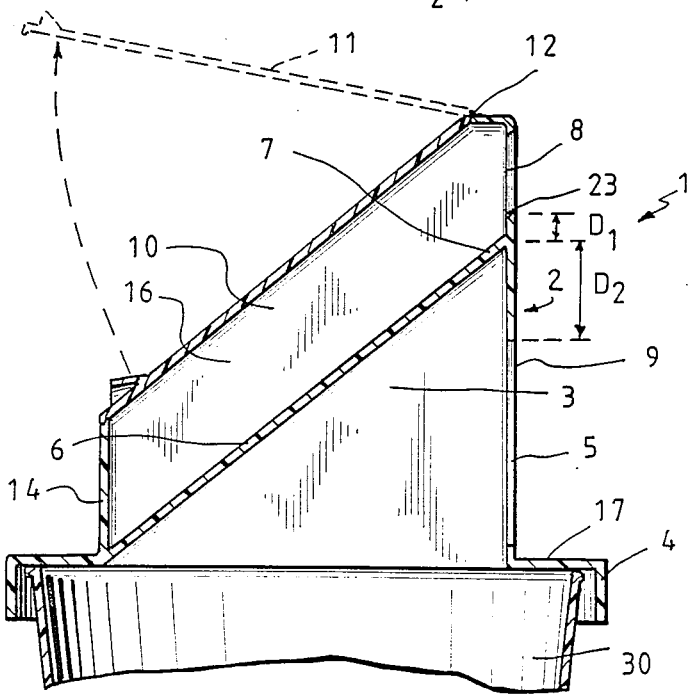
FIG. 2 is an elevated side cross-sectional view of the paper separation device of the present invention taken along line 2—2 of FIG. 1, shown with the top panel hingedly connected to the housing.
Figure 3:
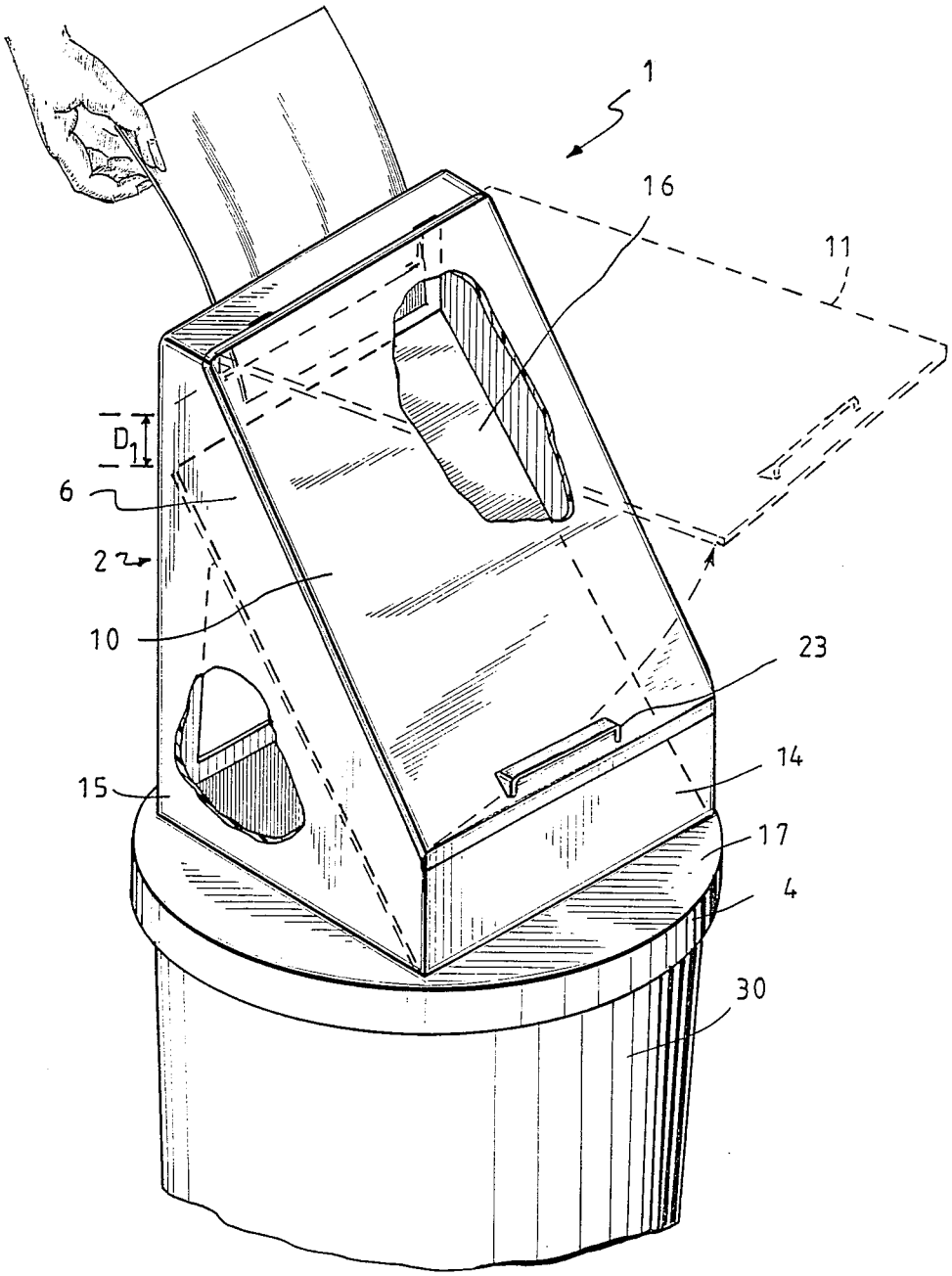
FIG. 3 is a perspective view of the rear portion of the paper separation device of the present invention placed over the central opening of the waste container, showing the insertion of a sheet of recyclable paper through the upper opening of the housing.

Referring to FIG. 2, the storage capacity of the storage compartment 16 can be made to whatever degree is desired by adjusting the distance between the upper edge portion 7 of the partition 6 (6′) and the lower edge portion 23 of the upper opening 8. This distance $D_1$ is illustrated in FIG. 2. Notably, the distance $D_2$ between the upper edge portion 24 of the lower opening 5 and the upper edge portion 7 of the partition 6 (6′) is less significant with respect to the operation of the present invention.

As illustrated in FIG. 2, in particular, the angle of inclination of the partition 6 (6′) with respect to the base 17, is approximately 45° as this parameter has been found empirically to have several advantages. One advantage in particular is that this angle of inclination ensures that a sheet or sheets of recyclable paper inserted through the upper opening 8 will slide down upon and over other sheets contained in the storage compartment 16 and collect in an orderly stacked fashion with minimal assistance from the user. Also, using a waste container of standard dimensions as would typically be found in an office setting, the 45° angle of inclination of the partition, provides for a lower opening 5 having dimensions suitable for the insertion of substantially large refuse articles.

It is contemplated that modification to the paper separation device hereof would involve making the geometry of the housing enclosure 2 different from that shown in the preferred embodiment. Such modification could involve providing the housing enclosure 2 with a semi-spherical geometry, wherein the upper and lower openings 8 and 5 respectively, would be formed in a section of the exterior surface of the semi-spherical structure, and the top cover panel 11 could be formed in the rear portion thereof, using hinging techniques known in the art. Even with a semispherical geometry, the preferred rectangular shaped storage compartment 16 can be formed within the housing enclosure 2, thus also providing for the insertion and receipt of sheets of recyclable paper therein without departing from the fundamental concept of the present invention.

Another contemplated modification of the present invention could involve modifying the depending flange 4 for maintaining the housing 2 upon a waste container, so that any container of a cylindrical, rectangular or other arbitrary shape, could be accomodated.

While the particular embodiment shown and discussed above has proven to be useful in many applications, further modifications of the present invention herein disclosed will occur to persons skilled in the art to which the present invention pertains and all such modifications are deemed to be within the scope and spirit of the present invention defined by the appended claims.

What is claimed is:

1. A removable separation device for placement over the central opening of various types of waste containers which comprises:
   - a single and removable housing having continuous walls forming an enclosure and an opening for fitting over a waste container;
   - a means for maintaining said housing upon the waste container;
   - a lower opening formed in one of said walls for entry of waste articles into the waste container;
   - an upper opening formed above said lower opening in said wall for inserting therethrough sheets of paper within said enclosure;
   - a partition disposed in said enclosure adapted to receive said sheets of paper and store said sheets of paper within said enclosure while simultaneously permitting said other waste articles to be deposited in said waste container;
   - an opening formed in said housing above said partition so that stored sheets of paper in said enclosure can be removed.

2. The paper separation device according to claim 1 which further comprises a top panel hingedly connected to said housing for covering said top opening.

3. The paper separation device of claim 2 which further comprises a lower panel hingedly connected to said housing, for covering said lower opening, and said lower panel depending downwardly from said housing to cover said lower opening and capable of swinging inwardly to entry of waste and like articles into the waste container.

4. The paper separation device of claim 1 wherein said housing and said means for maintaining said-housing upon the waste container are integrally formed.

5. The paper separation device of claim wherein said partition is hinged with respect to said housing for tilting upwardly to facilitate removal of stored sheets of paper within said enclosure.

6. The paper separation device of claim 5 wherein said housing further includes a support member disposed within said enclosure and extending towards said upper opening, said panel member providing support to the end of said partition.

7. The paper separation device of claim 6 wherein said paper separation device further includes a means for lifting said partition at the end thereof adjacent said support member, said lifting means graspable for tilting said partition so that one end thereof is disposed with respect to said top opening for removal of said stored sheets of paper in said enclosure.

* * * * *